US005231914A

United States Patent [19]

Hayase et al.

[11] Patent Number: 5,231,914

[45] Date of Patent: Aug. 3, 1993

[54] VARIABLE DISPLACEMENT COMPRESSOR

[75] Inventors: Isao Hayase, Katsuta; Kenji Tojo, Ibaraki; Kunihiko Takao; Yasushi Muramoto, both of Tsuchiura; Yukio Takahashi, Katsuta; Masaru Ito, Katsuta; Toshio Sudo, Katsuta; Takashi Yokoyama, Katsuta, all of Japan

[73] Assignees: Hitachi, Ltd., Tokyo; Hitachi Automotive Engineering Co., Ltd., Ibaraki, both of Japan

[21] Appl. No.: 738,561

[22] Filed: Jul. 31, 1991

[30] Foreign Application Priority Data

Sep. 14, 1990 [JP] Japan ..... 2-242411

[51] Int. Cl.[5] ..... F01B 3/02

[52] U.S. Cl. ..... 92/12.2

[58] Field of Search ..... 91/505-507; 92/12.2, 70, 71

[56] References Cited

U.S. PATENT DOCUMENTS

| | | | |
|---|---|---|---|
| 2,737,895 | 3/1956 | Ferris | 92/12.2 |
| 4,294,139 | 10/1981 | Bex et al. | 92/12.2 |
| 4,428,718 | 1/1984 | Skinner | 417/270 |
| 4,961,690 | 10/1990 | Simoyama et al. | 91/506 |

FOREIGN PATENT DOCUMENTS

| | | | |
|---|---|---|---|
| 1168773 | 10/1969 | United Kingdom | 91/506 |

*Primary Examiner*—Edward K. Look
*Assistant Examiner*—F. Daniel Lopez
*Attorney, Agent, or Firm*—Antonelli, Terry, Stout & Kraus

[57] ABSTRACT

A variable displacement swash plate type compressor is suitable for use as a refrigerant compressor for automobile air conditioner. The compressor includes pistons, an oscillating member for driving the piston, a rotating member for oscillating the oscillating member, a plate member for imparting a rotational force to the rotating member, and a main shaft connected to the plate member. A member, having a spherical or cylindrical surface portion and a flat surface portion, is provided between the rotating member and the plate member in such a manner that it is slidably in contact with both of the rotating member and the plate member. Also, movement of the oscillating member is defined by contact of the oscillating member with a stationary member. Consequently, it is possible to provide a variable displacement swash plate type compressor which assures reliable capacity control at a high-speed rotation and which vibrates and wears less. Furthermore, it is possible to prevent application of a thrust load to the drive shaft.

13 Claims, 11 Drawing Sheets

VARIABLE DISPLACEMENT COMPRESSOR

BACKGROUND OF THE INVENTION

The present invention realtes to a compressor, and more particularly, to a variable displacement swash plate type compressor suitable for use as a refrigerant compressor for automobile air conditioners.

In conventional variable displacement swash plate type compressors which are disclosed in, for example, U.S. Pat. No. 4,428,718, the swash plate is constituted by a swash plate portion and a boss portion integrally formed with the swash plate portion for rotatably supporting a piston support. The swash plate is supported at its boss portion in such a manner that it is inclinable by a sole sleeve which slides along a driving shaft. In the above-described structure, the swash plate portion is offset from the center of inclination of the swash plate with respect to the sleeve.

Furthermore, the piston support is prevented from rotating together with the swash plate by restricting the movement of a support pin protruding from the outer periphery of the piston support in the direction of rotation of the shaft by means of a guide groove provided in a front cover.

Furthermore, a pivot pin fixed to the lug of the swash plate is restricted by a cocoon-shaped cam groove formed in the drive lug fixed to the shaft so as to form a line contact portion through which a thrust compressive force acting on the pistons is transmitted to a thrust bearing supporting portion of the shaft.

The conventional method of defining the minimum capacity of a variable displacement compressor for use in automobile air conditioners has been described from page E-45 to page E-47 in Section of Air Conditioners E6 of Service Weekly Report R32 published by Nissan Automobile Co., Ltd. in May, 1989.

In this method, when the capacity of the compressor is changed, the movement of a hinge ball along a drive shaft is restricted. That is, when the capacity of the compressor is reduced, the hinge ball slides along the drive shaft toward the piston, and is brought into contact with a retaining ring through a stroking spring, by which the minimum capacity is defined. Also, a thrust bearing is provided at the end portion of the drive shaft located closer to the piston.

In the aforementioned conventional compressor disclosed in U.S. Pat. No. 4,428,718, the thrust compressive force acting on the pistons acts on the line contact portion between the pivot pin and the cam groove in the drive lug, and generates a large amount of area pressure, causing wear.

Furthermore, in the above conventional technique, the inclination moment on the swash plate surface due to a centrifugal force generated by the rotational motion of the swash plate portion is small as compared with the inclination moment on the swash plate surface in the opposite direction due to the inertial couple generated by the reciprocating motion of the pistons, allowing unbalanced inclination moment due to the force of inertia to exist.

The unbalanced inclination moment due to the force of inertia increases in proportion to the square of the rotational speed of the driving shaft and makes reduction in the swash plate angle at a high-speed rotation difficult because the inclination moment is the moment acting in a direction in which the swash plate angle increases.

Furthermore, as stated above, since the swash plate portion is offset from the center of the rotation of the swash plate with respect to the sleeve, the center of gravity of the swash plate portion is offset from the central axis of the rotation of the driving shaft in accordance with the inclination angle of the swash plate with respect to the driving shaft, and the resultant force of the centrifugal forces on the individual portions of the swash plate does not become zero. These unbalanced centrifugal forces and the above-described unbalanced moment can be a force against the external members of the compressor and can be a cause of vibrations.

Particularly, since the magnitude of the unbalanced force of inertia changes as the inclination angle of the swash plate changes as a consequence of control of the capacity of the compressor, even if a balance mass is fixed to the driving shaft, it is impossible to balance the force of inertia at all the inclination angles.

Furthermore, in the conventional technique, the support pin protruding from the piston support and restricted by the guide groove in the front cover reciprocates in the guide groove through the slide balls and a shoe. The force of inertia generated in the axial direction at that time can also be a force to the external members and can be cause of vibrations. Also, sliding of the shoe against the guide groove may generate wear or seizure.

In the conventional compressor described in Service Weekly Report, when the capacity of the compressor is controlled such that it is reduced, the thrust load (or thrust), directed from the drive hub to the piston, acts on the drive shaft, thus necessitating provision of a thrust bearing for receiving this thrust load by the end portion of the drive shaft located closer to the piston.

SUMMARY OF THE INVENTION

A primary object of the present invention is to provide a variable displacement swash plate type compressor which assures reliable capacity control even when the compressor is rotated at a high speed and which vibrates and wears less.

A secondary object of the present invention is to provide a variable displacement compressor which is capable of preventing application of a thrust load to a drive shaft when the capacity of the compressor is controlled to eliminate provision of a thrust bearing.

To achieve the primary object, the present invention provides a variable displacement compressor which includes pistons, an oscillating member for driving the pistons, a rotating member for oscillating the oscillating member, a plate member for imparting a rotational force to the rotating member, and a main shaft connected to the plate member. A member having a spherical and a flat surface portion is provided between the rotating member and the plate member in such a manner that it is slidably in contact with both of the rotating member and the plate member.

The present invention further provides a variable displacement compressor which includes pistons, an oscillating member for driving the pistons, a rotating member for oscillating the oscillating member, a plate member for imparting a rotational force to the rotating member, and a main shaft connected to the plate member. The compressor further includes a first supporting portion for supporting the oscillating member in such a manner that an oscillation angle thereof is variable, a second supporting portion for supporting the rotating member in such a manner that an inclination angle thereof relative to the main shaft is variable, and a third supporting portion for slidably supporting the rotating member and the plate member.

The present invention further provides a variable displacement compressor which includes pistons, an oscillating member for driving the pistons, a rotating member for oscillating the oscillating member, a plate member for imparting a rotational force to the rotating member, and a main shaft connected to the plate member. The compressor further includes a first supporting portion for supporting the oscillating member in such a manner that an oscillation angle thereof is variable, and a second supporting portion for supporting the rotating member in such a manner that an inclination angle thereof relative to the main shaft is variable. The first supporting portion comprises a universal joint mechanism for coupling a sleeve disposed around the main shaft to the oscillating member.

To achieve the second object of the present invention, the present invention provides a variable displacement compressor which includes a stationary member, pistons reciprocating within the stationary member, and an oscillating member for driving the pistons and in which the oscillating member can be moved in a direction in which the pistons reciprocate. At least one limit of the movement range of the oscillating member is defined by contact of the oscillating member with the stationary member with an intermediate member therebetween.

The present invention further provides a variable displacement compressor which includes a stationary member, pistons reciprocating within the stationary member, an oscillating member for driving the pistons, a rotary member driven by a main shaft for oscillating the oscillating member, a first supporting portion for supporting the oscillating member in such a manner that an oscillating angle can be varied, and a second supporting portion for supporting the rotary member in such a manner that an inclination angle thereof relative to the main shaft can be varied, and in which the oscillating member can be moved in a direction in which the pistons reciprocate. At least one limit of the movement range of the oscillating member is defined by contact of the oscillating member with the stationary member with an intermediate member therebetween.

The present invention further provides a variable displacement compressor which includes a stationary member, pistons reciprocating within the stationary member, an oscillating member for driving the pistons, a rotary member driven by a main shaft for oscillating the oscillating member, a first supporting portion for supporting the oscillating member in such a manner that an oscillating angle can be varied, and a second supporting portion for supporting the rotary member in such a manner that an inclination angle thereof relative to the main shaft can be varied, and in which the oscillating member can be moved in a direction in which the pistons reciprocate. At least one limit of the movement range of the oscillating member is defined by contact with the first supporting portion with the stationary member.

The present invention further provides a variable displacement compressor which includes a stationary member, pistons reciprocating within the stationary member, an oscillating member for driving the pistons, a rotary member driven by a main shaft for oscillating the oscillating member, a first supporting portion for supporting the oscillating member in such a manner that an oscillating angle can be varied, and a second supporting portion for supporting the rotary member in such a manner that an inclination angle thereof relative to the main shaft can be varied, and in which the oscillating member can be moved in a direction in which the pistons reciprocate. At least one limit of the movement range of the oscillating member is defined by contact of the second supporting portion with the stationary member.

At least one limit of the movement range of the oscillating member is defined by contact of the first supporting portion with the stationary member with an intermediate member therebetween.

At least one limit of the movement range of the oscillating member is defined by contact of the second supporting portion with the stationary member with an intermediate member therebetween.

The surface of the intermediate member which comes into contact with the oscillating member is spherical.

The present invention further provides a variable displacement compressor in which a spring is provided with at least one of the oscillating member, the intermediate member, the stationary member and the first supporting portion at the contact position.

The member having the spherical and flat surface portions is provided between the plate member and the rotating member, and the spherical and flat surface portions thereof are respectively in contact with the plate member and the rotating member. Therefore, the area pressure when the thrust compressive force acting on the piston is transmitted is small, and wear or seizure of that portion does not occur easily.

Provision of the second supporting portion reduces a distance of the center of gravity of the mass of which inclination angle with respect to the driving shaft changes from the axis of the driving shaft and variations in the distance caused by the capacity control, thereby reducing the magnitude of the centrifugal force acting on the center of gravity and variations in the centrifugal force caused by changes in the inclination angle of the swash plate.

Since reduction in the centrifugal force acting on the center of gravity reduces the magnitude of the moment generated in a direction in which the inclination angle of the mass increases, the magnitude of the moment acting in a direction in which the inclination angle decreases due to the centrifugal forces acting on the individual portions of the mass increases. Also, since offset of the center of gravity from the driving shaft and variations in the offset relative to the inclination angle of the swash plate are less, the moment acting in a direction in which the inclination angle of the swash plate is decreased can be increased without increasing the magnitude of centrifugal force and variations in the centrifugal force with respect to the inclination angle of the swash plate by increasing the magnitude of the mass of which inclination angle with respect to the driving shaft changes. Consequently, the generated moment can be easily balanced with the inclination moment generated in a direction in which the inclination angle of the swash plate is increased due to the reciprocative motion of the individual pistons.

Furthermore, since rotation of the oscillating member is restricted by the first supporting portion, unbalanced mass for generating reciprocative motion in the axial direction is eliminated, and the force of inertia which generates vibrations is thus reduced.

When the capacity of the variable displacement compressor is controlled, the oscillating member including the piston support for driving the piston moves in the axial direction of the main shaft while changing the inclination thereof with respect to the main shaft. Consequently, the minimum capacity of the compressor is defined by bringing the oscillating member into direct contact with the stationary member, e.g., the cylinder block, or with the intermediate member therebetween and thereby defining the movement of the oscillating member in the direction of the main shaft, i.e., in the direction in which the pistons reciprocate. As a result, the thrust generated when the capacity of the compressor is controlled is transmitted from the oscillating member to the stationary member, and the thrust load acting on the main shaft can thus be eliminated.

DESCRIPTION OF THE PREFERRED EMBODIMENT

A first embodiment of the present invention will now be described with reference to FIGS. 1 to 10.

Figure 7:
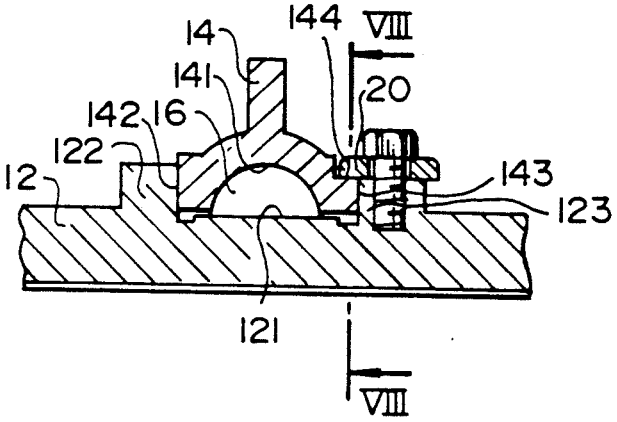
FIG. 7 is a section taken along the line VII—VII of FIG. 1.
Figure 8:
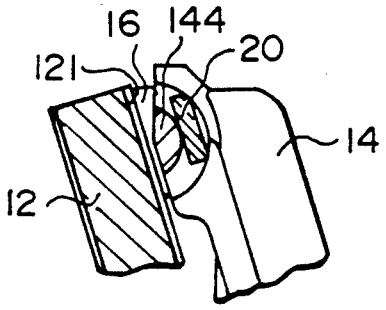
FIG. 8 is a section taken along the line VIII—VIII of FIG. 7.

A housing includes a front housing 1 and a cylinder block 2. That is, the cup-like front housing 1 for rotatably supporting a main shaft 13 at its central portion through a radial needle roller bearing 19 is coaxially disposed at and fixed to one end of the cylindrical cylinder block 2 to form a swash plate chamber 10. In the cylinder block 2, a plurality of cylinders 201 and disposed around the main shaft 13 in such a manner that the central line of each cylinder 33 is parallel to the axis of the main shaft 13. The main shaft 13 is rotatably supported substantially on the central line of the cylinder block 2 by the radial needle roller bearings 18 and 19 respectively provided at the central portion of the cylinder block 2 and the front housing 1. A drive plate 14 is fixed to the main shaft 13 by press fitting, using a pin, plastic coupling or the like. The drive plate 14 is formed with a recessed spherical surface portion 141. A shoe 16 which is a sphere having the same radius as that of the spherical surface portion 141 is in contact with the spherical surface portion 141 so as to be rotatable about the center of the sphere which forms the spherical surface portion 141. The shoe 16 has a flat surface portion. A flat surface portion 121 provided on a swash plate 12 is slidably in contact with the flat surface portion of the shoe 16. That is, the center of the recessed spherical surface portion 141 of the drive plate 14 is always at a fixed distance from the flat surface portion 121 of the swash plate 12. As shown in FIG. 7, the drive plate 14 has on both sides of the spherical surface portion 141 flat surface portions 142 and 143 onto which lugs 122 and 123 of the swash plate 12 are respectively inserted. As shown in FIG. 8, the drive plate 14 has a cylindrical surface portion 144 whose central axis passes through the center of the spherical surface portion 141. A stopper 20 mounted on the swash plate 12 parallel to the flat surface portion 121 is slidably in contact with the cylindrical surface portion 144.

Thus, when the drive plate 14 is rotated by the rotation of the main shaft 13, rotational force is transmitted from the flat surface portion of the drive plate 14 to the lug 122 of the swash plate 12, thus rotating the swash plate 12. A swash plate sleeve 15 is fitted on the main shaft 13 so as to be movable in the axial direction of the main shaft 13. The swash plate sleeve 15 is coupled to the swash plate 12 by means of swash plate sleeve pins 17 in such a manner that the swash plate 12 is inclinable about the swash plate sleeve pins 17 with respect to the swash plate sleeve 15. Thus, rotation of the main shaft 13 rotates the drive plate 14, the swash plate 12 and the swash plate sleeve 15 altogether.

Figure 3:
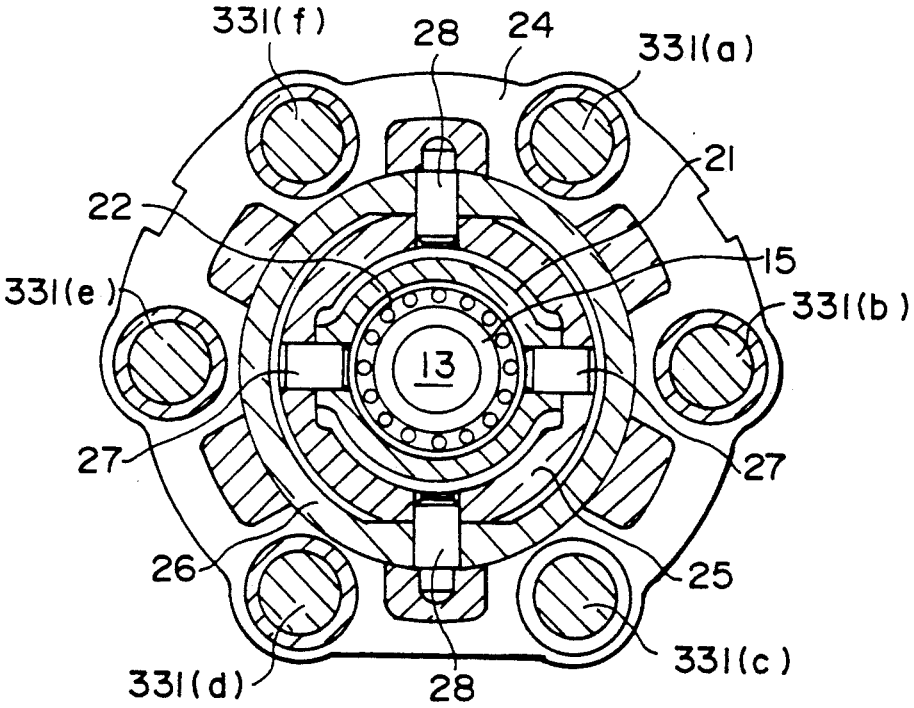
FIG. 3 is a section taken along the line III—III of FIG. 2.
Figure 4:
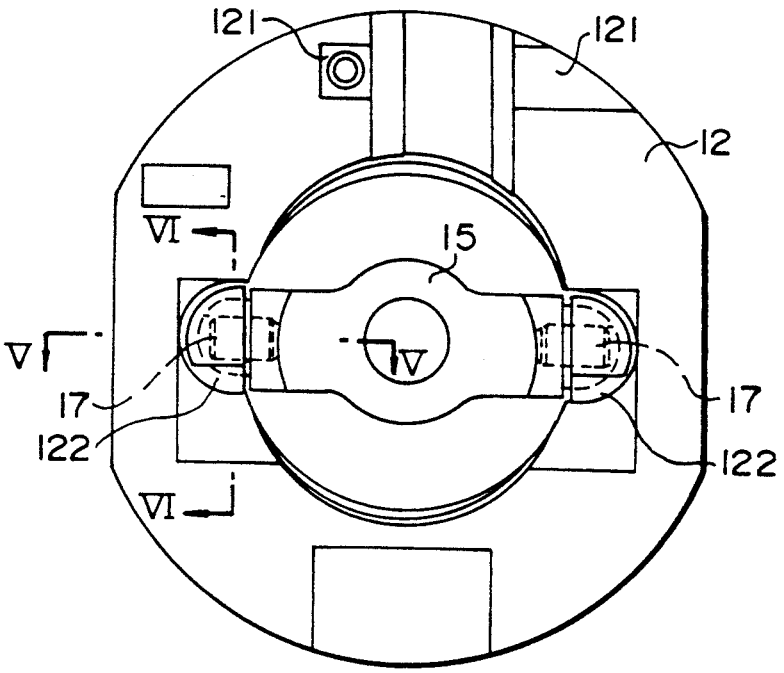
FIG. 4 is a front view of a swash plate assembly of the present invention.

An annular piston support 24 is disposed adjacent to and on the side of the swash plate 12 closer to the cylinder block 2 with a thrust bearing 29 therebetween. As shown in FIG. 3, an outer ring 26 is provided on the inner periphery of the piston support 24, and an inner ring 25 is disposed on the inner periphery of the outer ring 26. The piston support 24 and the outer and inner rings 26 and 25, coupled to each other by means of support sleeve pins 28, in combination form an oscillating member. To prevent each of the support sleeve pins 28 from rotating about its own axis between the piston support 24 and the outer ring 26, the portion of each of the support sleeve pins 28 which is in contact with the inner and outer rings 25 and 26 has a cylindrical cross-section, while the portion thereof which is in contact with the piston support 24 has two parallel surfaces which are parallel to the axis of the main shaft 13. A support sleeve 21 is fitted on the outer periphery of the swash plate sleeve 15 with a roller bearing 22 therebetween. The support sleeve 21 is coupled to the inner ring 25 by support sleeve pins 27 disposed at positions deviating from the support sleeve pins 28 by 90 degrees in the circumferential direction. Thus, the outer and inner rings 26 and 25, the support sleeve 21 and support sleeve pins 28 and 27 in combination constitute a universal joint.

Figure 5:
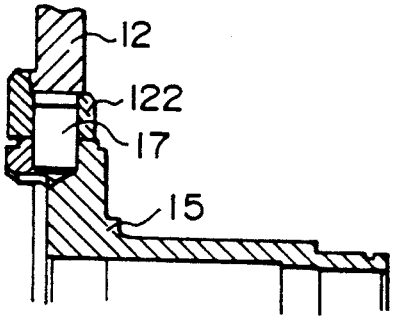
FIGS. 5 and 6 are respectively cross-sections taken along the line V—V and VI—VI of FIG. 4.
Figure 6:
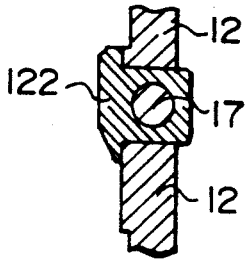

The piston support 24 and the swash plate 12 are coupled to each other by the swash plate sleeve 15 and the support sleeve 21 so as to be rotatable relative to each other. That is, the swash plate sleeve 15 and the support sleeve 21 are mechanically coupled to each other with a resilient body 32 and a spring supporting bearing 30 therebetween, and at the same time form a roller pair of the roller bearing 22. The resilient body 32 applies a pre-load between the swash plate 12 and the swash plate sleeve 15 and between the swash plate 12 and the piston support 24. More specifically, the resilient body 32 presses the swash plate sleeve 15 to the right as viewed in FIG. 1, thus pressing the swash plate 12 to the right through the swash plate sleeve pins 17 and swash plate lugs 122, as shown in FIG. 5. Consequently, the swash plate 12 and the swash plate sleeve 15 are not separated from each other, and the swash plate 12 inclines about the swash plate sleeve pins 17. The resilient body 32 also presses the support sleeve 21 to the left. This force of the resilient body 32 is transmitted from the support sleeve 21 to the support sleeve pins 27, the inner race 25, the support sleeve pins 28, the outer ring 26 and then to the piston support 24, thus pressing the piston support 24 to the left, i.e., toward the swash plate 12. This prevents the piston support 24 from separating from the swash plate 12. Provision of the thrust bearing 29 between the swash plate 12 and the piston support 24 facilitates rotation of the swash plate 12.

The support sleeve 21 has on its outer peripheral surface recessed portions 251 each of which extends in the axial direction and which can slide along a corresponding slide pin 23 fixed to a bearing housing 201 of the cylinder block 2. This prevents the piston support connected to the support sleeve 21 by the support sleeve pins 27 and 28 from rotating about the main shaft 13. A plurality of connecting rods 33, each having balls 331 and 332 at the both ends thereof, are mounted on the surface of the piston support 24 closer to the cylinder block 2 so as to be rotatable about the center of the ball 331. A piston 11 is mounted on the other end of each of the connecting rods 33 so as to be rotatable about the center of the ball 332.

The piston support 24 has a plurality of recessed spherical surface portions 241 in its circumferential direction. One end of the connecting rod 33, having the spherical surface portions 331 and 332 at its both ends, is mounted on each of the recessed spherical surface portions 241 so as to be rotatable around the center of the spherical surface portion 241. A piston 11 is mounted on the other end of each of the connecting rods 33 so as to be rotatable around the center of its recessed spherical surface portion 111. The plurality of pistons 11 are respectively fitted in a plurality of cylinders 201 in a state where piston rings 34 and 35 are mounted on each piston 11.

In the cylinder block 2, a suction valve plate 5, a cylinder head 4, a discharge valve plate 6, a packing 7, and a rear cover 3 are provided. The cylinder block 2, together with the front housing 1 provided in such a manner that it surrounds the drive plate 14, the swash plate 12, and the piston support 24, is fixed to the rear cover 3 by means of bolts (not shown). The connecting portion between the front housing 1 and the cylinder block 2 is sealed by an O-ring 36, and the connecting portion between the rear cover 3 and the cylinder block 2 is sealed by an O-ring 37. In the cylinder head 4, a suction port 401 and a discharge port 402 are provided for each cylinder 201. The suction ports 401 and the discharge ports 402 respectively are communicated with a suction chamber 8 and a discharge chamber 9 provided in the rear cover 3. The rear cover 3 has a suction port 301 and a discharge port (not shown). A control valve 38 is provided in a suction passage 40 which connects the suction port 301 to the suction chamber 8. The upstream portion of the control valve 38 is communicated with the swash plate chamber 10 in the front housing 1 through a communicating hole (not shown). The downstream portion of the control valve 38 is communicated with the suction chamber 8.

In the compressor arranged in the manner described above, when the main shaft 13 of the compressor is driven by an engine (not shown), the drive plate 14 and the swash plate 12 rotate, thereby oscillating the piston support 24 relative to the main shaft 13 and hence reciprocating the pistons 11 within the corresponding cylinders 201. Consequently, refrigerant returned from a refrigerating cycle flows into the compressor from the suction port 301, passes through the control valve 38 which controls (reduces) the pressure of the refrigerant to an adequate value so that an adequate pressure difference exists between the pressure in the upstream portion of the control valve, i.e., that in the swash plate chamber 10, and that in the downstream portion of the control valve 38, and is then led into the suction chamber 8 formed in the rear cover 3. Thereafter, the refrigerant passes through the suction port 401 of the cylinder head 4, then the suction valve plate 5, and flows into the cylinder 201, thereby completing the suction stroke. The refrigerant which has been compressed by the pistons 11 passes through the discharge portion 402 in the cylinder head 4 then the discharge valve plate 6, is discharged into the discharge chamber 9 formed in the rear cover 3, and is sent out to the refrigerating cycle (not shown) from a discharge port (not shown). Control of the capacity of the compressor is performed by controlling the moment of the swash plate 12 which is achieved by adjusting the pressure difference between the suction chamber 8 and the swash plate chamber 10, i.e., the pressure difference between the both sides of the pistons 11 and thereby changing the position and the magnitude of the resultant force of the forces acting on the piston support 24 from the individual pistons 11 through the corresponding connecting rods 33.

Figure 9:
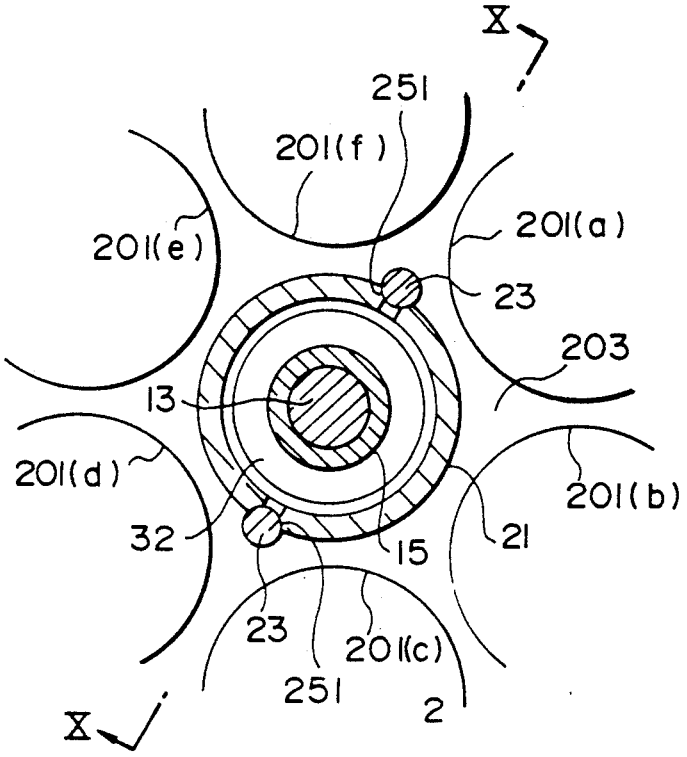
FIG. 9 is a section taken along the line IX—IX of FIG. 1.

The structure for defining the minimum capacity of the compressor will be described in detail with reference to FIGS. 9 and 10. As stated above, the slide pins 23 are fixed to the bearing housing 203 of the cylinder block 2 at two positions symmetrical with respect to the main shaft 13. Recessed portions 251 are formed in the axial direction in the outer peripheral surface of the support sleeve 21 at positions corresponding to the slide pins 23. Engagement of the recessed portions 251 and the slide pins 23 prevents the support sleeve 21 from rotating about the main shaft 13, which in turn prevents rotation of the piston support 24 about the main shaft 13. Consequently, the piston support 21 oscillates during the rotation of the swash plate 12.

Figure 1:
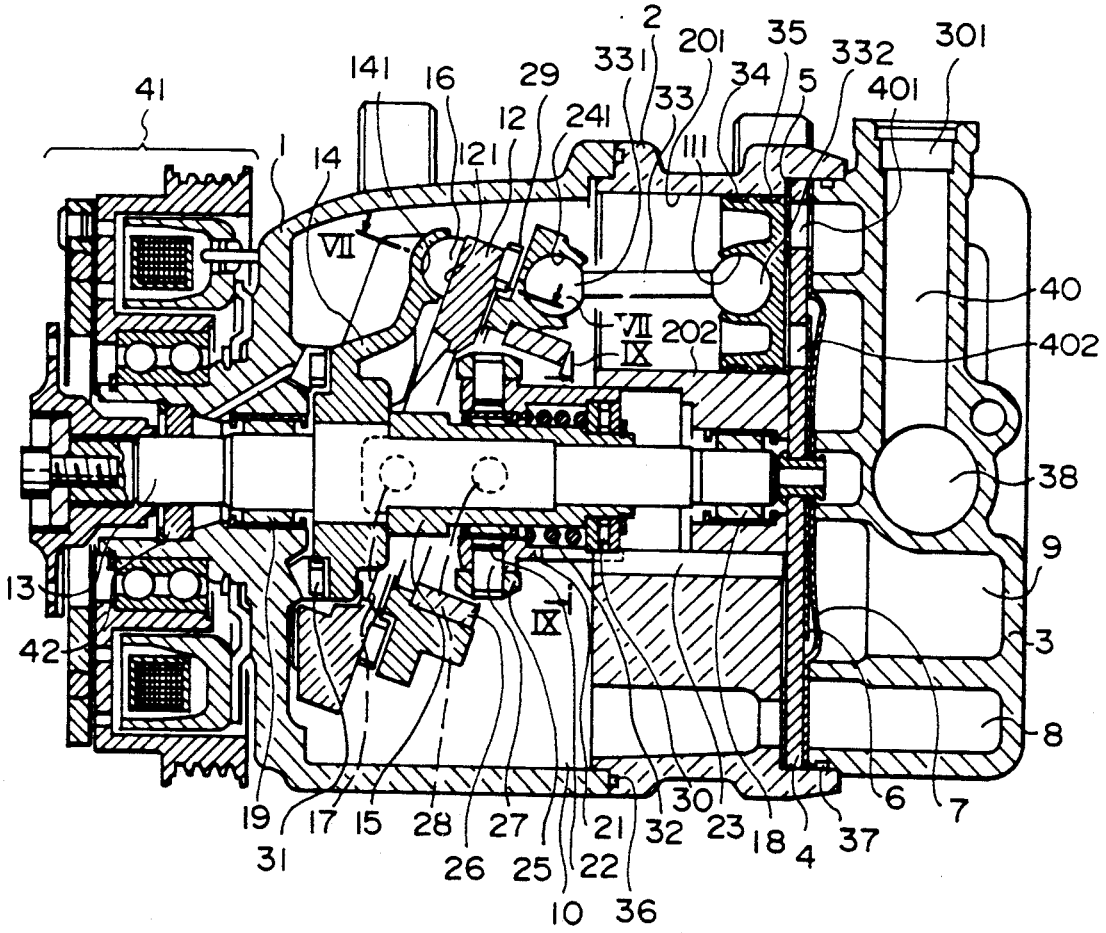
FIG. 1 is a vertical cross-sectional view of a first embodiment of the present invention which is in the maximum capacity state.
Figure 2:
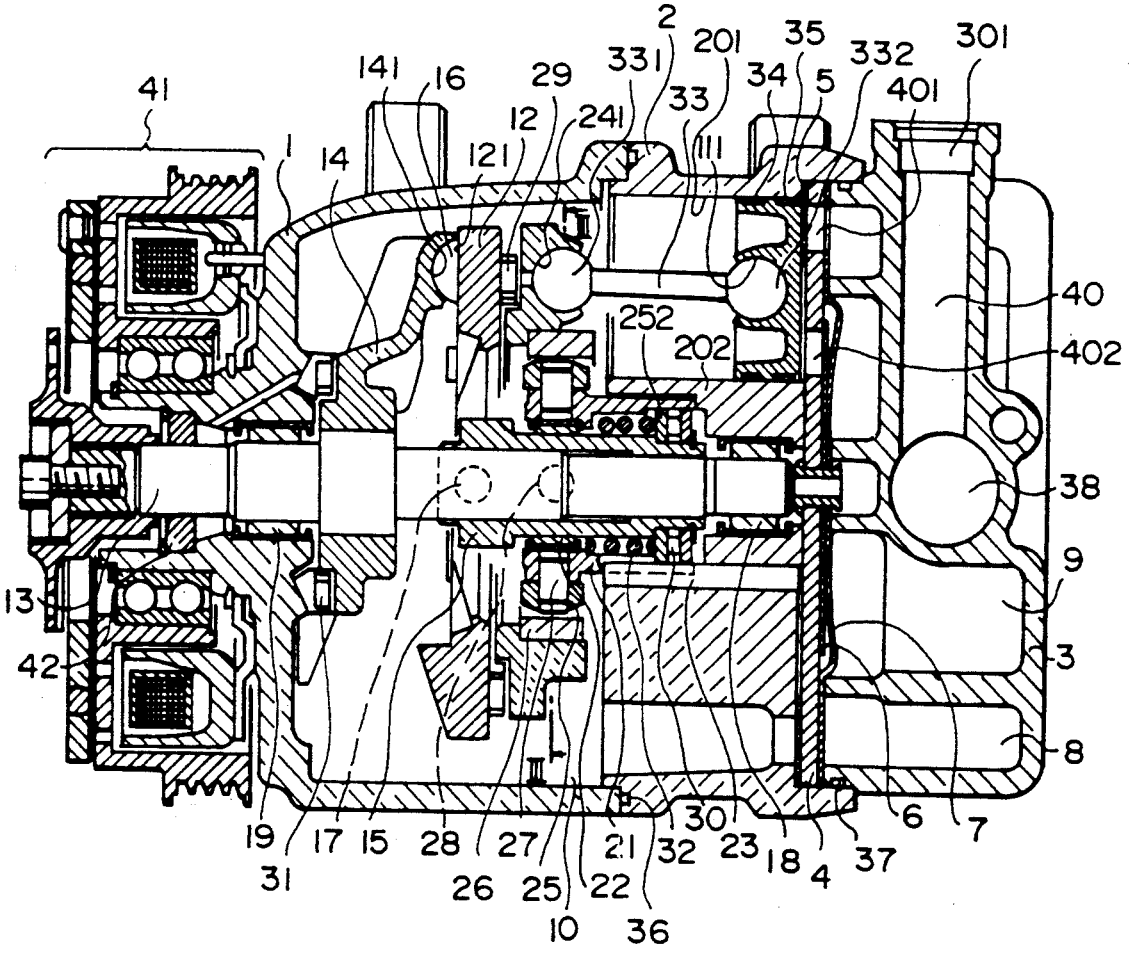
FIG. 2 is a vertical cross-sectional view of the first embodiment of the present invention which is in the minimum capacity state.
Figure 10:
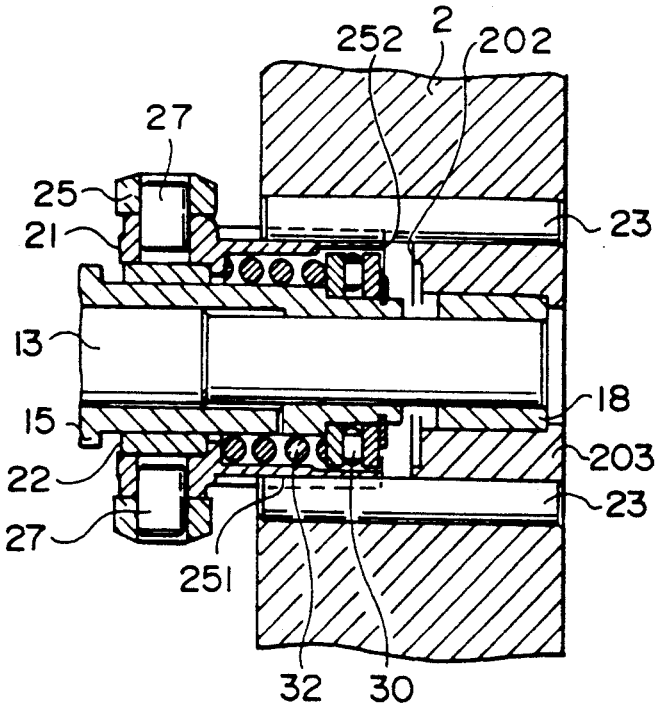
FIG. 10 is a section taken along the line X—X of FIG. 9

When the capacity of the compressor is reduced from the maximum to the minimum, the swash plate sleeve 15 slides to the right as viewed in FIG. 10 to allow the inclination angle of the swash plate 12 to be gradually reduced. The support sleeve 21 connected to the swash plate sleeve 15 through the rolling bearing 22 also moves to the right in the axial direction together with the swash plate sleeve 15 with the recessed portions 251 of the support sleeve 21 sliding along the slide pins 23 (FIG. 2). After an end portion 252 of the support sleeve 21 closer to the cylinder head 4 abuts against an end portion 202 of the bearing housing 203 of the cylinder block 2, the capacity of the compressor no longer reduces, and the minimum capacity of the compressor is thus defined. At that time, whereas the support sleeve 21 is in contact with the cylinder block 2, the swash plate sleeve 15 is free from the main shaft. Therefore, in this embodiment, the thrust generated on the main shaft in the rightward direction as viewed in FIG. 10 when the capacity is reduced to the minimum is zero. In other words, a thrust bearing conventionally provided on the right end portion of the main shaft 13 can be eliminated.

In this embodiment, since the center of gravity of the swash plate 12 can be held on the rotary axis of the main shaft 13 by means of the swash plate sleeve pins 17, generation of the centrifugal force can be eliminated at any inclination angle of the swash plate. Furthermore, while generation of the centrifugal force can be eliminated by increasing the mass of the swash plate 12, the moment generated by the reciprocative motion of the individual pistons 11 can be substantially completely cancelled to each other. It is therefore possible to provide a variable displacement swash plate type compressor which vibrates less and which is capable of reliable capacity control even when it is rotated at a high speed.

In this embodiment, rotation of the piston support 24 is prevented by means of the support sleeve 21 and the universal joint mechanism comprising the inner and outer races 25 and 26 and the support sleeve pins 27 and 28 which are Provided in the vicinity of the central portion of the piston support 24. As a result, sliding generated as a consequence of the oscillation of the piston support 24 is limited to the oscillation of the inner and outer races 25 and 26 about the support sleeve pins 27 and 28. Also, the sliding speed is very small. It is therefore possible to provide a variable displacement swash plate type compressor which does not readily generate wear or seizure.

Furthermore, the semi-spherical shoe 16 is provided between the drive plate 14 and the swash plate 12, and the spherical and flat surface portions of the shoe 16 are respectively in contact with the drive plate 14 and the swash plate 12. Therefore, the area pressure when the thrust compressive force acting on the piston 11 is transmitted is small. It is therefore possible to provide a variable displacement swash plate type compressor which does not readily generate wear or seizure at that portion.

The above description explains the variable displacement swash plate compressor of the type in which the inclination angle of the swash plate is varied by lowering the pressure in the cylinder suction port than that in the swash plate chamber which is kept at constant using the control valve. However, the present invention can also be applied to a variable displacement swash plate compressor of the type in which the inclination angle of the swash plate is varied by raising the pressure in the swash plate chamber than that at the cylinder inlet which is kept at constant by utilizing blow-by gas or the like, which is disclosed, for example, in Japanese Patent Examined Publication No. 58-4195.

Figure 11:
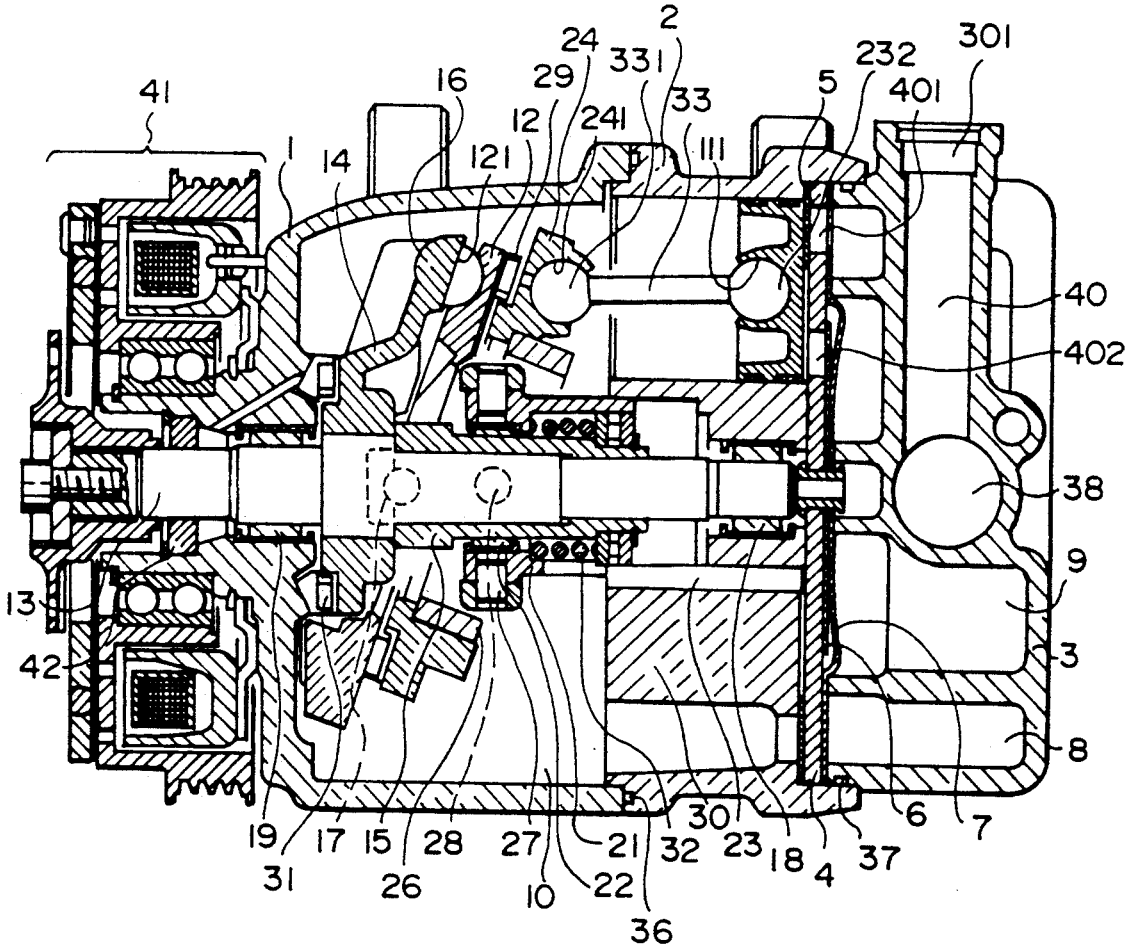
FIG. 11 is a vertical cross-sectional view of a second embodiment according to the present invention which is the maximum capacity state.

FIG. 11 is a vertical cross-sectional view of a second embodiment of the variable displacement swash plate type compressor according to the present invention, showing the maximum capacity state thereof. This compressor differs from that shown in FIG. 1 in that the spherical surface portion of the shoe 16 provided between the drive plate 14 and the swash plate 12 is in surface contact with the swash plate 12 while the flat surface portion thereof is in surface contact with the drive plate 14.

In the second embodiment, the area pressure when the thrust compressive force acting on the piston 11 is transmitted can be reduced, and generation of wear or seizure in the compressor can be reduced, as in the first embodiment.

Figure 12:
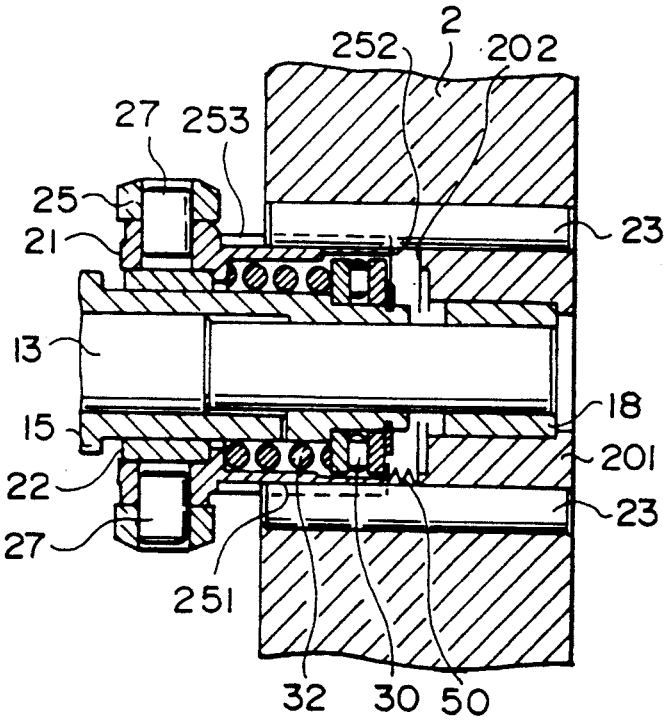
FIG. 12 is a sectional view of the essential parts of a third embodiment of the present invention.

FIG. 12 is a cross-sectional view of the essential parts of a third embodiment of the present invention. In this embodiment, a spring 50 is provided between the end portion 252 of the support sleeve 21 and the end portion 202 of the bearing housing of the cylinder block 2. The spring 50 may be provided on either of the support sleeve 21 or on the end portion of the bearing housing. Alternatively, the spring 50 may be fixed to a neck portion 253 of the support sleeve 21 in such a manner that it can be brought into contact with the cylinder block 2 and the slide pins 23, although not illustrated in FIG. 12. That is, the spring 50 can be provided in any manner so long as it is disposed between the support sleeve 21 and the cylinder block 2.

In this embodiment, in addition to the aforementioned advantages, it is possible to moderate impacts generated by the contact of the support sleeve 21 with the cylinder block 2 when the capacity of the compressor is reduced to the minimum. Furthermore, when the capacity is increased from the minimum, the spring force will accelerate movement of the support sleeve 21 and thereby improves the controllability.

Figure 13:
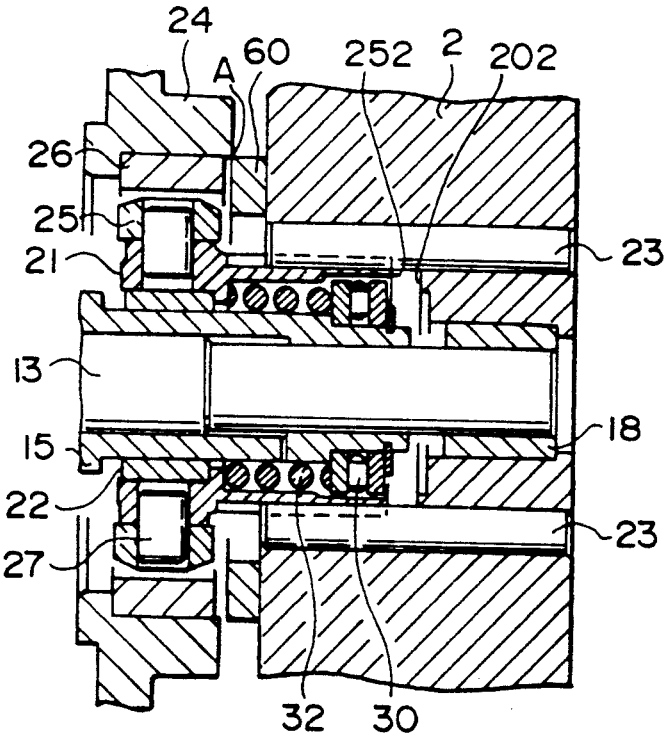
FIG. 13 is an enlarged cross-sectional view of the essential parts of a fourth embodiment of the present invention.

FIG. 13 is an enlarged cross-sectional view of the essential parts of a fourth embodiment of the present invention.

In this embodiment, the minimum capacity of the compressor is defined by the outer ring 26 and the cylinder block 2. Although not shown in FIG. 13, a space between the piston support 24 and the cylinder block 2 is enlarged by using longer connecting rods, and a ring-shaped inclination angle defining member 60 is provided in this enlarged space as an intermediate member. The inclination angle defining member 60 is fixed to the cylinder block 2 in such a manner that it does not interfere with the pistons 11 located at the lower dead point. This may be achieved by extending the end portion of the cylinder block 2 closer to the swash plate chamber 10 so as to allow the pistons 11 to be accommodated within the cylinder 201 even when the pistons 11 are moved to the lower dead point.

When the capacity of the compressor is reduced to the minimum, the outer ring 26 comes into contact with the inclination angle defining member 60 at point "A". Since the inclination angle defining member 60 is flat, this point "A" moves as the main shaft 13 rotates and returns to its origina. position when the main shaft 13 has made one rotation. At that time, space is present between the distal end portion 252 of the support sleeve 21 and the end portion 202 of the bearing housing of the cylinder block 2, preventing direct contact between the support sleeve 21 and the cylinder block 2. Furthermore, the minimum capacity of the compressor can be easily changed by changing the thickness of the inclination angle defining member 60. In this embodiment, the contact surface between the inclination angle defining member 60 and the outer ring 26 is made flat. However, the contact surface may also be made spherical. This improves the contact state.

Thus, in this embodiment, since the minimum capacity can be defined at a point remote from the rotation axis of the main shaft, stable contact is assured. Furthermore, the minimum capacity of the compressor can easily be changed by changing the thickness of the inclination angle defining member.

In the above-described embodiments, the means for or method of defining the minimum capacity of the compressor by bringing the cylinder block and the piston support, which are the stationary member, into contact with each other through the intermediate member has been described.

Figure 14:
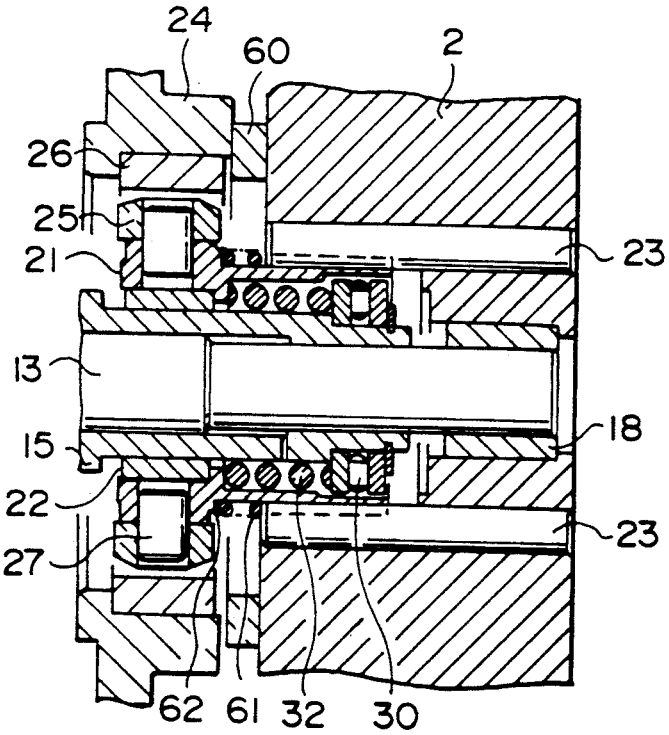
FIG. 14 is an enlarged cross-sectional view of the essential parts of a fifth embodiment of the present invention.

FIG. 14 shows a fifth embodiment of the present invention in which the piston support is directly brought into contact with the stationary member to define the minimum capacity of the compressor.

A space is provided between the piston support 24 and the end portion of the cylinder block 2 closer to the swash plate chamber 10, and the inclination angle defining member 60 provided in that space is fixed to the cylinder block 2. A stroking spring 61 is provided on the support sleeve 21 through a retaining ring 52.

When the inclination angle of the swash plate is reduced, the stroking spring 61 first comes into contact with the cylinder block 2 and the slide pins 23. Thereafter, the support sleeve 21 further slides to the right against the spring force of the stroking spring 61, and finally the piston support 24 comes into contact with the inclination angle defining member 60 to attain the minimum capacity. The contact surface between the piston support 24 and the inclination angle defining member 60 moves as the main shaft rotates, as stated above. In this embodiment, although the surface of the inclination angle defining member 60 is made flat, it may also be spherical.

In this embodiment, since motion of the piston support can directly be defined, reliable definition of the minimum capacity position is possible. Furthermore, the minimum capacity can be defined at a point remote from the rotation axis of the main shaft, stable definition is possible.

The stroking spring may also be provided between the inclination angle defining member 60 and the piston support or the outer ring 21.

In the above-described embodiments, the variable displacement compressor of the type in which the inclination angle of the swash plate is changed by reducing the pressure in the cylinder inlet port than that in the swash plate chamber which is maintained at constant by means of the control valve has been described. However, the present invention can also be applied to a variable displacement compressor of the type in which the inclination angle of the swash plate is controlled by increasing the pressure in the swash plate chamber using the blow-by gas or discharge gas while maintaining the pressure in the cylinder inlet port at constant, as is disclosed in Japanese Patent Examined Publication No. 58-4195.

Figure 15:
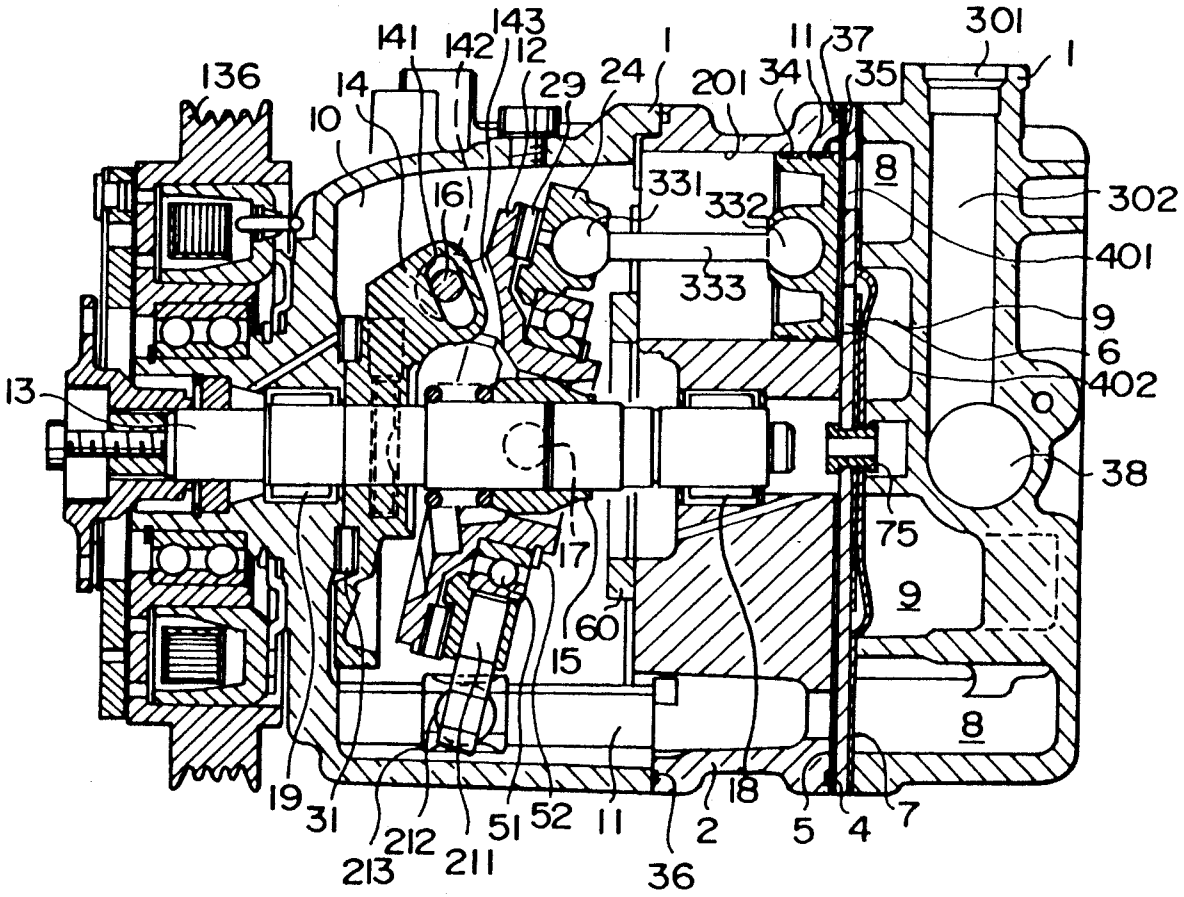
FIG. 15 is a vertical cross-sectional view of a sixth embodiment of the present invention.

FIG. 15 shows an example of such a conventional variable displacement compressor to which the present invention is applied.

The sleeve 15 is mounted on the main shaft 13 so as to be slidable in the axial direction of the main shaft 13. The sleeve 15 is coupled to the swash plate 12 by the sleeve pins 17 in such a manner that it is rotatable about the sleeve pins 17 with respect to the sleeve 15. As the sleeve 15 slides in the rightward direction as viewed in FIG. 15, the inclination angle of the swash plate 12 decreases. The drive plate 14 is fixed to the main shaft 13 by the press fitting or using a pin or plastic coupling or the like. The drive plate 14 has a lug portion 141 having a cam groove 142. A pivot pin 16 provided on the swash plate is movable fitted in the cam groove 143. The side surface of the lug portion 141 of the drive plate 14 is in contact with the side surface of a lug shaft 121 of the swash plate 13. Thus, rotation of the main shaft 13 rotates the drive plate 14, the swash plate 12 and the sleeve 15 altogether.

The piston support 24 is held in contact with the swash plate 12 with a ball bearing 51 therebetween. The ball bearing 51 is pre-loaded and thereby fixed to a nose portion of the swash plate by a retaining ring 52. The piston support 24 has a rotation-preventing mechanism constituted by a support pin 211, a slide ball 212 and a slide shoe 213, by which rotation of the piston support 24 about the main shaft 13 is restricted. That is, the outer ring of the ball bearing 51 located closer to the piston support 24 does not rotate, and is thereby regarded as part of the oscillating member.

As the main shaft 13 rotates, the drive plate 14 and the swash plate 12 rotate while the piston support 24 oscillate so as to allow the pistons 11 reciprocate in the cylinders 201.

The inclination angle defining member 60 is fixed to the end portion of the cylinder block 2 located closer to the swash plate chamber 10 as the intermediate member. It is however noted that the inclination angle defining member 60 is provided such that it does not interfere with the pistons 11 located at the lower dead point thereof.

In the compressor arranged in the manner described above, when the capacity of the compressor is reduced, the sleeve 15 moves along the main shaft 13 to the right as viewed in FIG. 15, while the inclination angle of the swash plate 12 and piston support 24 reduces. When the portion of the ball bearing 51 located closer to the piston support 24 (the other ring) comes into contact with the inclination angle defining member 60, the minimum capacity is defined.

In this embodiment, the inclination angle defining member 60 comes into contact with part of the ball bearing. However, it may also be arranged such that the piston support comes into contact with the inclination angle defining member 60. Also, a spring may be provided between the inclination angle defining member and the oscillating member, such as the piston support.

As will be understood from the foregoing description, in the present invention, since the sliding speed and area pressure at the sliding portion of the compressor can be reduced, durability of the compressor can be improved.

Furthermore, since unbalanced force of inertia, such as a centrifugal force or a moment, can be greatly reduced, it is possible to provide a variable displacement swash plate type compressor which generates less vibrations or noises. This allows comfort in the vehicle to be improved.

Furthermore, since the moments which are generated by the force of inertia and which are capable of changing the inclination angle of the swash plate can be cancelled to each other, reliability of the variable displacement swash plate type compressor at a high-speed rotation can be improved.

Furthermore, since the minimum capacity of the compressor can be defined by bringing the oscillating member into contact with the stationary member directly or with the intermediate member therebetween not through the main shaft, the thrust load applied to the main shaft when the capacity is controlled can be reduced to zero, and provision of a thrust bearing provided at the rear end portion of the main shaft can be eliminated.

What is claimed is:

1. A variable displacement compressor comprising:
pistons;
an oscillating member for driving said pistons;
a rotating member for oscillating said oscillating member;
a plate member for imparting a rotational force to said rotating member; and
a main shaft connected to said plate member;
wherein a member having a spherical surface portion and a flat surface portion is provided between said rotating member and said plate member in such a manner that said member having said spherical and said flat surface portions is slidably in contact with both of said rotating member and said plate member.

2. A variable displacement compressor according to claim 1, wherein said spherical surface portion is slidably in contact with a spherical surface portion of said rotating member, while said flat surface portion is slidably in contact with a flat surface portion of said plate member.

3. A variable displacement compressor according to claim 1, wherein said spherical surface portion is slidably in contact with a spherical surface portion of said plate member, while said flat surface portion is slidably in contact with a flat surface portion of said rotating member.

4. A variable displacement compressor comprising:
pistons;
an oscillating member for driving said pistons;
a rotating member for oscillating said oscillating member;
a plate member for imparting a rotational force to said rotating member;
a main shaft connected to said plate member;
a swash plate sleeve fitted on said main shaft so as to be movable;
a support sleeve fitted on said swash plate sleeve rotatable relative to said swash plate sleeve;
a first support portion, formed on said support sleeve, for supporting said oscillating member in such a manner that an oscillation angle thereof relative to said shaft is variable;
a second supporting portion, formed on said swash plate sleeve separately from said first supporting portion, for supporting said rotating member in such a manner that an inclination angle thereof relative to said shaft is variable; and
a third supporting portion for slidably supporting said rotating member and said plate member.

5. A variable displacement compressor according to claim 4, wherein said third supporting portion comprises a member provided between said rotating member and said plate member, said member having a spherical surface portion and a flat surface portion and said member being slidably in contact with both of said rotating and plate members.

6. A variable displacement compressor comprising:
pistons;
an oscillating member for driving said pistons;
an rotating member for oscillating said oscillating member;
a plate member for imparting a rotational force to said rotating member;
a main shaft connected to said plate member;
a first supporting portion for supporting said oscillating member in such a manner that an oscillation angle there is variable; and
a second supporting portion for supporting said rotating member in such a manner that an inclination angle thereof relative to said main shaft is variable;
wherein said first supporting portion comprises a universal joint mechanism for coupling a support sleeve disposed around said main shaft to said oscillating member, said universal joint mechanism is axially movable in accordance with variation of the oscillation angle of said oscillating member, said universal joint mechanism comprising an outer ring rotatably connected to said oscillating member by first support sleeve pins and an inner ring rotatably connected to said outer ring by second support sleeve pins, wherein each second support sleeve pin is disposed at an angle of 90 degrees relative to a corresponding one of said first support sleeve pins.

7. A variable displacement compressor comprising:
a stationary member;
Pistons reciprocating within said stationary member; and
an oscillating member for driving said pistons, said oscillating member being movable in a direction in which said pistons reciprocate;
wherein a limit of a movement range of said oscillating member for a minimum capacity of said compressor is defined by contact of said oscillating member with said stationary member with an intermediate member therebetween.

8. A variable displacement compressor comprising:
a stationary member;
pistons reciprocating within said stationary member;
an oscillating member for driving said pistons;
a rotary member driven by a main shaft for oscillating said oscillating member;
a first supporting portion for supporting said oscillating member in such a manner that an oscillating angle can be varied; and
a second supporting portion for supporting said rotary member in such a manner that an inclination angle thereof relative to said main shaft can be varied, said oscillating member being movable in a direction in which said pistons reciprocate;
wherein a limit of a movement range of said oscillating member for a minimum capacity of said compressor is defined by contact of said oscillating member with said stationary member with an intermediate member therebetween.

9. A variable displacement compressor comprising a stationary member, pistons reciprocating within said stationary memory, an oscillating member for driving said pistons, a rotary member driven by a main shaft for oscillating said oscillating member, a first supporting portion for supporting said oscillating member in such a manner that an oscillating angle can be varied, and a second supporting portion for supporting said rotary member in such a manner that an inclination angle thereof relative to said main shaft can be varied, said oscillating member being movable in a direction in which said pistons reciprocate,
wherein at least one limit of the movement range of said oscillating member is defined by contact with said first supporting portion with said stationary member.

10. A variable displacement compressor according to claim 9, further comprising a compression spring provided on said first supporting portion.

11. A variable displacement compressor according to claim 9, wherein said first support portion is brought into contact with said stationary member with an intermediate member therebetween to define the at least one limit of the movement range.

12. A variable displacement compressor comprising:

a stationary member;

pistons reciprocating within said stationary member;

an oscillating member for driving said pistons;

a rotating member for oscillating said oscillating member, said oscillating member being movable in the direction in which said pistons reciprocate;

a plate member for imparting a rotational force to said rotating member; and a main shaft connected to said plate member;

wherein a member having a spherical surface portion and a flat surface portion is provided between said rotating member and said plate member in such a manner that said member having said spherical and flat surface portions is slidably in contact with both of said rotating member and said plate member; and wherein at least one limit of a movement range of said oscillating member is defined by contact of said oscillating member with said stationary member with an intermediate member therebetween.

13. A variable displacement compressor comprising:

a stationary member;

pistons reciprocating within said stationary member; and an oscillating member for driving said pistons, said oscillating member being movable in a direction in which said pistons reciprocate;

wherein at least one limit of the movement range of said oscillating member is defined by contact of said oscillating member with said stationary member with an intermediate member therebetween; and wherein a surface of said intermediate member in contact with said oscillating member is spherical.

* * * * *